US005293183A

United States Patent [19]

Kim

[11] Patent Number: 5,293,183

[45] Date of Patent: Mar. 8, 1994

[54] HEAT BLOWING EQUIPMENT OF THERMAL PRINT HEAD FOR COLOR VIDEO PRINTER

[75] Inventor: Jai S. Kim, Suwon, Rep. of Korea

[73] Assignee: Goldstar Co., Ltd., Seoul, Rep. of Korea

[21] Appl. No.: 998,574

[22] Filed: Dec. 18, 1992

[30] Foreign Application Priority Data

Dec. 20, 1991 [KR] Rep. of Korea ..... 91-23635

[51] Int. Cl.[5] ..... B41J 29/377

[52] U.S. Cl. ..... 346/146; 400/719

[58] Field of Search ..... 346/76 PH, 146; 400/120, 719

[56] References Cited

U.S. PATENT DOCUMENTS 5,053,792 10/1991 Une ..... 346/76 PH

*Primary Examiner*—Benjamin R. Fuller
*Assistant Examiner*—Huan Tran
*Attorney, Agent, or Firm*—Helfgott & Karas

[57] ABSTRACT

The present invention relates to heat blowing equipment for a thermal print head of a color video printer, in which a radiating plate is mounted on the upper surface of the thermal print head and a ventilation fan is directly connected to the upper portion of the radiating plate, thereby being moved together with the head during the up and down operation of the head. Accordingly, a proper temperature is continuously maintained regardless of any position change of the head. The ventilation fan is mounted on a fan guide, which is coupled to the radiating plate by a plurality of levers, so that the structure always effectively cools the thermal print head regardless of any position change of the head.

6 Claims, 4 Drawing Sheets

HEAT BLOWING EQUIPMENT OF THERMAL PRINT HEAD FOR COLOR VIDEO PRINTER

BACKGROUND OF THE INVENTION

The present invention relates to a heat blowing structure for a thermal print head of a color video printer, and more particularly to heat blowing equipment for mounting a heat blowing fan interlocked with the up and down operation of a thermal print head, thereby improving heat blowing effect during printing.

With reference to FIG. 1 which is a whole sectional view of a conventional color video printer, the construction of conventional equipment is described.

A conventional thermal print head 4 is mounted on the end of a holder 5, which is connected rotatably by a hinge 6. And, a radiating plate 3 is mounted on the upper side of the thermal print head 4, as shown in FIG. 2. A platen roller 11 for printing by pressing dye film 8 and printing paper 15 are provided in the lower portion of the thermal print head 4, and a grip roller 9 and a pinch roller 10 for feeding the printing paper 15 are mounted to one side of the platen roller 11.

Dye film 8 is provided on the inside of a dye film cassette 7, in such a manner that the dye film 8 is rolled around a supply reel 7*b* and a take-up reel 7*a*. A heat blowing fan 1 is fixed with a cover 14 by fixing means such as a screw 2, above the thermal print head 4.

In the arrangement described above, if printing paper 15 is supplied by the grip roller 9 and the pinch roller 10 in response to a print signal, the holder 5 where the thermal print head 4 and the radiating plate 3 are mounted is moved to a lower position around the hinge 6, and presses the dye film and the printing paper on the platen roller 11 as shown in FIG. 1. Here, printing paper 15 is fed by the rotation of grip roller 9, thereby being printed. The holder 5 comprising the radiating plate 3 and the thermal print head 4 moves up and down around the hinge 6 by conventional lever equipment, according to the rotation of a cam 13.

When the thermal print head 4 generates heat to print thermally on the printing paper 15, the heat generated in the head 4 is cooled through the radiating plate 3. That is, the fan 1 fixed on the cover 14 cools the radiating plate 3 by circulating external air. In such a conventional cooling structure, since the cooling fan 1 is fixed with the cover 14, it is impossible for air to be sent to the radiating plate at both of two positions, i.e., at the upper position before/after printing and the lower position during printing. That is, since the thermal print head 4 moves to the lower portion during printing, wind supplied from the fan 1 is exactly transferred to the radiating plate 3. However, in this case, when the printing is completed or is in a continuous printing mode, since the thermal print head 4 moves to the upper position, i.e., into a standby position, the radiating plate 3 becomes relatively far removed from the direction of the wind supplied from the fan 1, so that it is difficult to be well ventilated. Particularly during continuous printing, the temperature of the thermal print head should be constant and like its temperature upon first starting. However, if the print head is not reliably cooled in the standby state of the thermal print head, i.e., in the upper position before being in contact with the platen roller, there is a problem of deterioration in printing quality because of differences in color tone and color strength, compared with the print picture of a normal state.

SUMMARY OF THE INVENTION

It is an object of the present invention to provide heat blowing equipment for a thermal print head which is reliable in constantly keeping the print state of clear picture, so as to solve the problem.

It is another object of the present invention to provide ventilation equipment to be interlocked with the up and down operation of a thermal print head, thereby continuously cooling and keeping the temperature of head at a proper level.

To achieve the object, the heat blowing equipment for a thermal print head according to the present invention comprises radiating means attached on the upper side of a head for scattering heat from a thermal print head, and ventilation means interlocked with the up and down operation of the thermal print head for directly and continuously emitting heat from the radiating means so as to continuously maintain the temperature of a thermal print head at the proper level.

Also, heat blowing equipment for the thermal print head according to the present invention further comprises a fan guide on which a fan as the ventilation means is fixed, and a plurality of levers whose two ends are respectively coupled to said fan guide and a radiating plate, for making radiating equipment rotatable between one position, supported on the radiating plate to maximally emit heat from the radiating plate as radiating means in an upper position of the thermal print head, and another position supported on the upper side of the dye film cassette in the lower position of the thermal print head.

BRIEF DESCRIPTION OF THE DRAWINGS

The above objects and other advantages of the present invention will become more apparent by describing the preferred embodiment of the present invention with reference to the attached drawings, in which:

FIG. 6A is a sectional view showing the state of before-printing, FIG. 6B is a sectional view showing the state of during-printing, and FIG. 6C is a plan view of thermal print head showing the state of during-printing.

DETAILED DESCRIPTION OF THE INVENTION

The heat blowing equipment according to an embodiment of the present invention directly mounts a fan assembly F for ventilation on the upper portion of radiating plate 3 mounted on the upper side of thermal print head 4.

Figure 1:
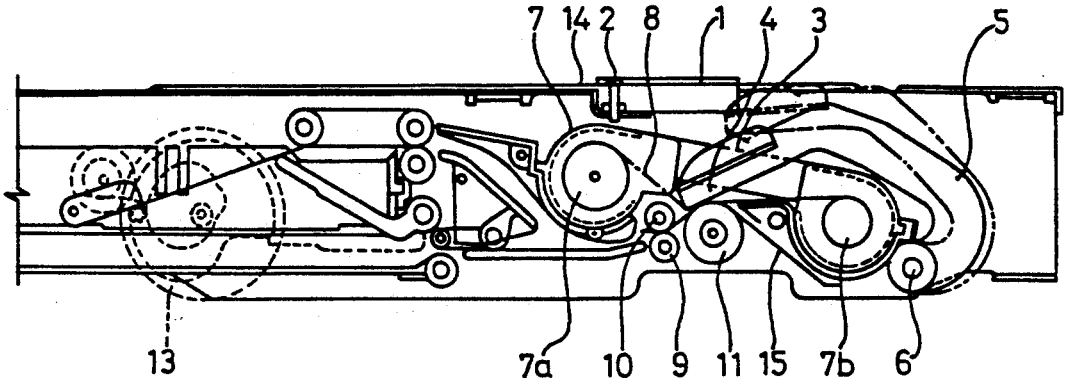
FIG. 1 (PRIOR ART)
FIG. 1 is a schematic sectional view of a thermal print head showing the overall construction of a conventional color video printer.
Figure 2:
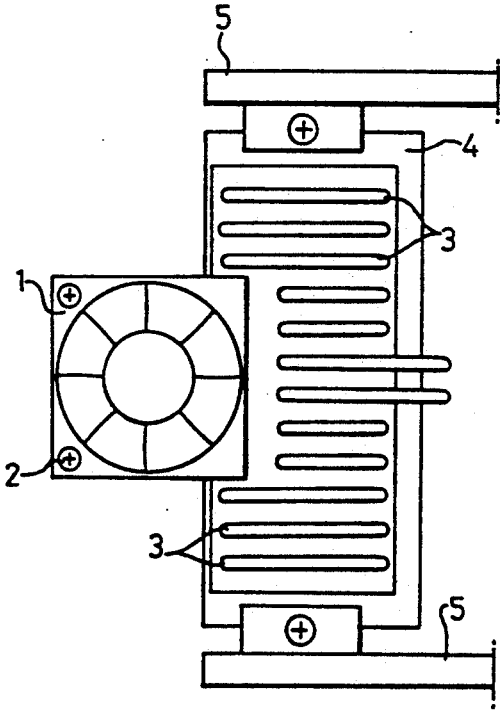
FIG. 2 (PRIOR ART)
FIG. 2 is a plan view of a conventional thermal print head.
Figure 3:
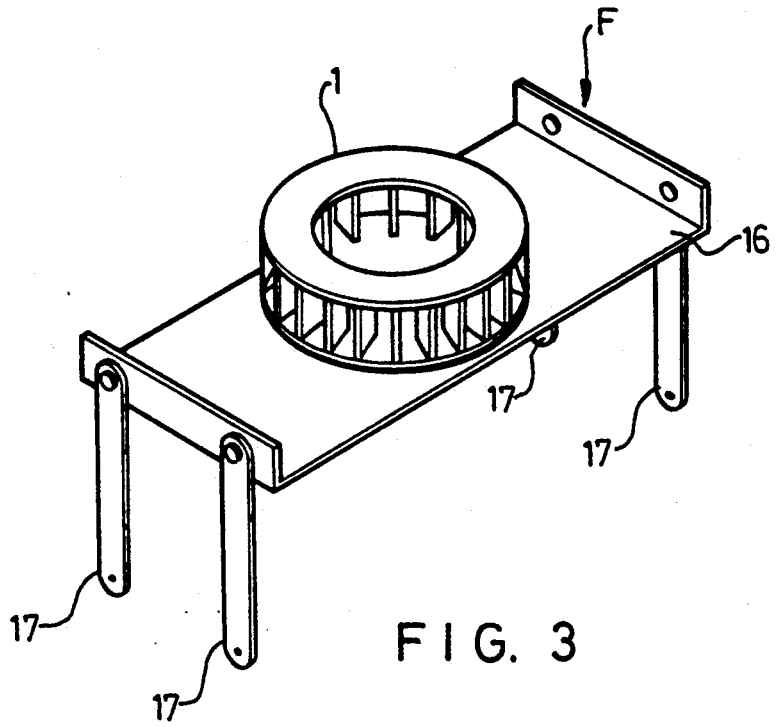
FIG. 3 is a perspective view of a fan assembly according to the present invention.
Figure 6A:
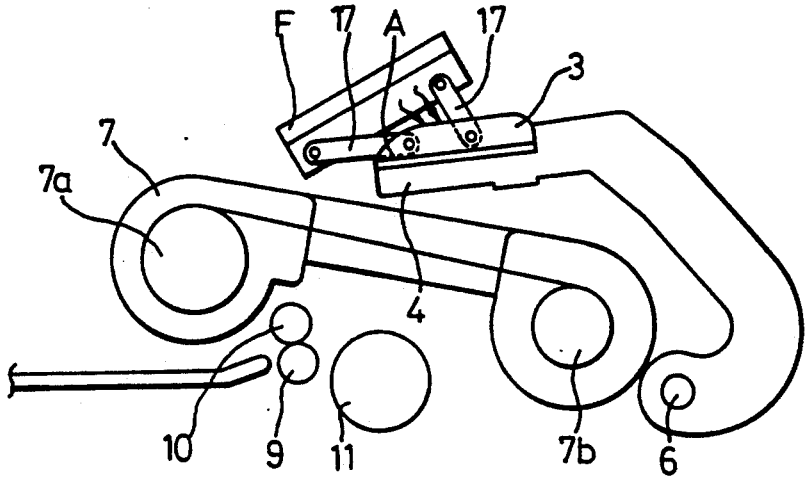
FIGS. 6A to 6C are views to explain the operation of the thermal print head in which a fan assembly of the present invention is mounted, where
Figure 6B:
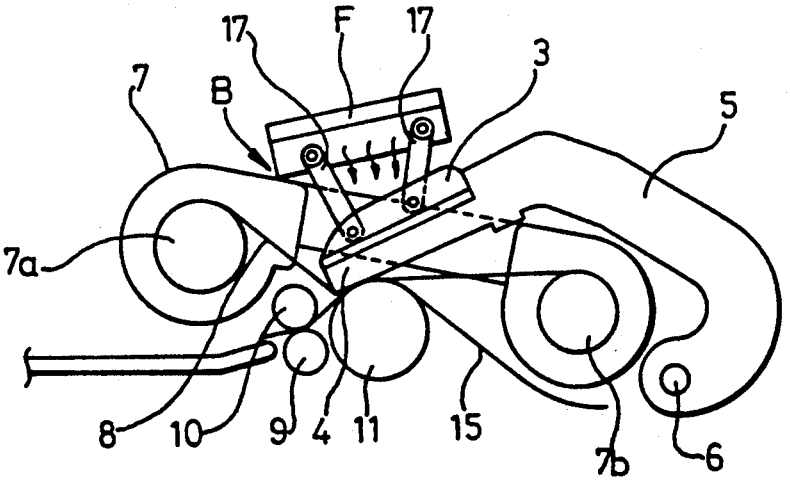

That is, since the fan assembly shown in FIG. 3 is directly mounted on the upper portion of the radiating plate 3 as shown in FIGS. 6A and 6B, ventilation by a fan 1 is directly transferred to the radiating plate 3 regardless of the up or down position of the head 4 (i.e., print ready state, or printing state), so that the thermal print head continuously maintains a proper temperature.

The fan assembly F comprises fan 1 for ventilation, a mounting fan guide 16 for mounting the fan, and a plurality of levers for coupling the fan guide and the radiating plate.

Through an embodiment shown in FIGS. 3 through 6C, the present invention is described in more detail.

Figure 4:
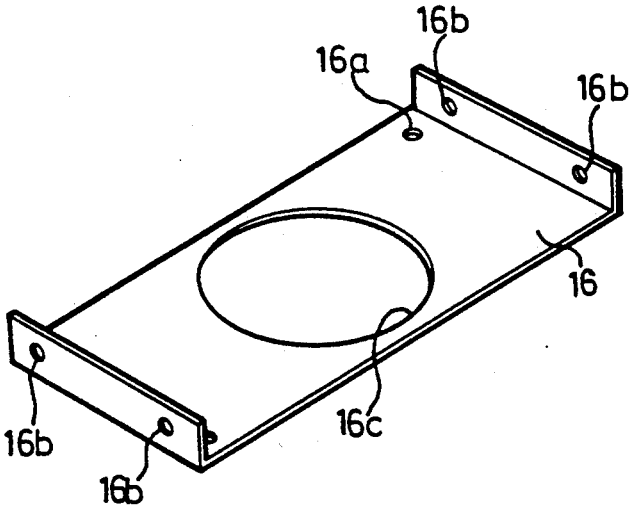
FIG. 4 is a perspective view of a fan guide for mounting a fan according to the present invention.
Figure 5:
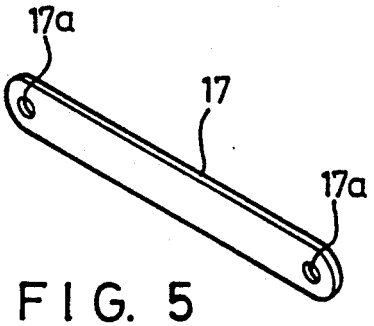
FIG. 5 is a perspective view of a lever for coupling a fan assembly according to the present invention.

As shown in FIG. 4, the fan guide 16 for mounting the ventilation fan 1 comprises a mounting hole **16*c* for mounting the fan 1 at the center, and a plurality of tap holes 16*a* for fixing the fan at the edges of the center. And, a plurality of tap holes 16*b* for coupling the levers 17** are provided in opposite side walls of fan guide whose longitudinal section is formed in "C".

The plurality of levers 17 for coupling the fan guide 16 to the radiating plate comprise mounting holes **17*a* for coupling the radiating plate 3 and the fan guide 16** on both their sides, respectively.

Figure 6C:
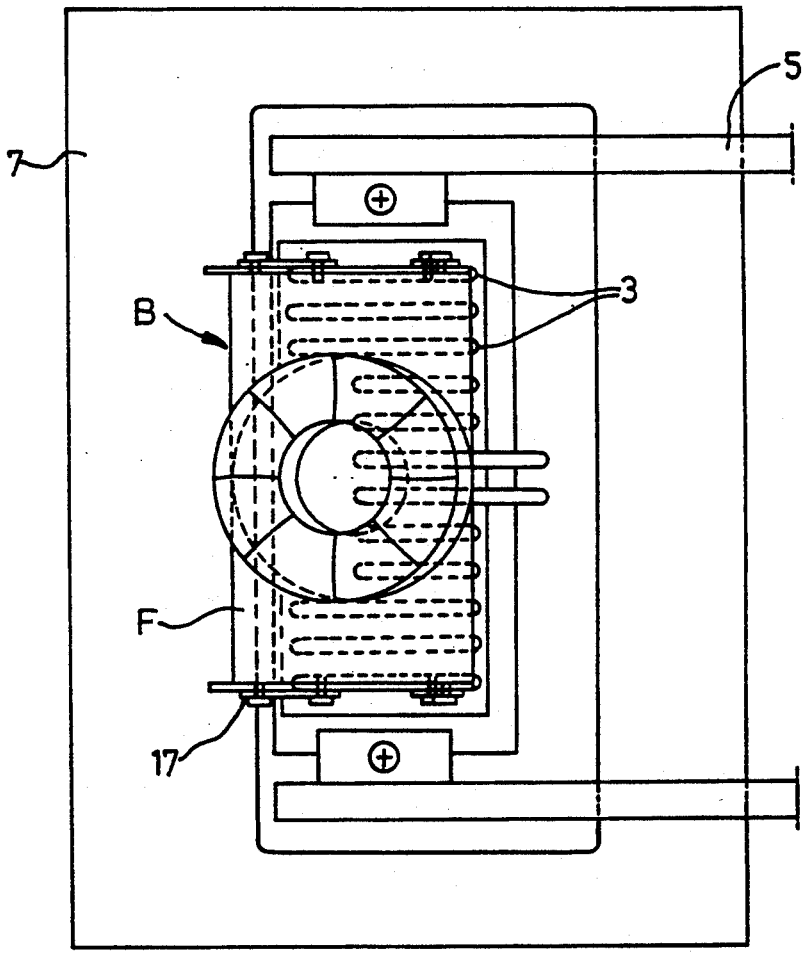

One end of the lever 17 is rotatably mounted on the tap hole **16*b* formed on the side of guide 16, and its other end is rotatably mounted on the side of the radiating plate 3. That is, as shown in FIGS. 6A to 6C, the fan assembly F is mounted on the upper portion of the radiating plate 3. The fan guide 16, where the fan 1 is mounted, is mounted on the upper portion of radiating plate 3 by the plurality of levers 17, which are rotatably coupled to the fan guide 16 and the radiating plate 3, so that the fan assembly F rotates as shown in FIGS. 6A and 6B with respect to the up and down movement of the holder 5**.

Hereinafter, the operation of the present invention is described with reference to FIGS. 6A to 6C.

The fan assembly F mounted on the upper portion of radiating plate is supported on the radiating plate 3 (refer to "A" part of FIG. 6A) by the levers 17 to cool the radiating plate and maintain a constant distance from the radiating plate as shown in FIG. 6A, in a ready state before printing, i.e., in the upper position of head 4. And, if the thermal print head 4 moves to the lower position in response to a print signal, as shown in FIG. 6B, the fan assembly F is supported on the upper surface of dye film cassette 7 (refer to "B" part of FIGS. 6B and 6C) and sends air precisely from the upper portion of the radiating plate 3 to the radiating plate, keeping a constant distance from the radiating plate 3 moved down, thereby achieving a cooling effect on radiating plate 3.

As described above, the present invention has an advantage of sending air precisely to the radiating plate, regardless of any position change of the radiating plate, by mounting a fan on the upper portion of a thermal print head, compared with a conventional fan which is fixed on the cover 14 for ventilation. Accordingly, since elimination of the heat generated in a printer of thermal transfer type is effectively achieved, the problem of indefiniteness of picture due to high temperature is solved. There is an advantage of providing a high quality print by always keeping the thermal print head a proper temperature.

What is claimed is:

1. Heat blowing equipment for a thermal print head, comprising:

radiating means attached to an upper surface of said thermal print head for scattering heat from said thermal print head;

ventilation means for emitting heat from said radiating means; and means for mounting said ventilation means to said radiating means so as to place said ventilation means to a first position relative to said radiating means when said thermal print head moves upwards and to a second position different from said first position relative to said radiating means when said thermal print head moves downwards.

2. Heat blowing equipment for a thermal print head as claimed in claim 1, wherein said ventilation means comprising:

a fan for ventilation; and a fan guide for supporting said fan.

3. Heat blowing equipment for a thermal print head as claimed in claim 2, wherein said mounting means comprises a plurality of levers rotatably mounted on said fan guide and said radiating means.

4. Heat blowing equipment for a thermal print head as claimed in claim 3, wherein said ventilation means is supported on said radiating means by said levers at an upper position of said thermal print head, and on an upper surface of a dye film cassette at a lower position of said thermal print head.

5. Heat blowing equipment for a thermal print head, comprising:

radiating means attached to an upper surface of said thermal print head for scattering heat from said thermal print head; and ventilation means operatively associated with an up and down movement of said thermal print head for emitting heat from said radiating means, said ventilation means being rotatably mounted on said radiating means and including a fan for ventilation, a fan guide for mounting said fan, and a plurality of levers rotatably mounted on said fan guide and said radiating means.

6. Heat blowing equipment for a thermal print head as claimed in claim 5, wherein said ventilation means is supported on said radiating means by said levers at an upper position of said thermal print head, and on an upper surface of a dye film cassette at a lower position of said thermal print head.

* * * * *